US006726510B2

(12) United States Patent
Norbert et al.

(10) Patent No.: US 6,726,510 B2
(45) Date of Patent: Apr. 27, 2004

(54) CABLE LUG

(75) Inventors: Emil Schad Norbert, Hohenlinden (DE); Falk Hardt, Muenchberg (DE)

(73) Assignee: Tyco Electronics Raychem GmbH (DE)

( * ) Notice: Subject to any disclaimer, the term of this patent is extended or adjusted under 35 U.S.C. 154(b) by 0 days.

(21) Appl. No.: 10/275,342

(22) PCT Filed: May 15, 2001

(86) PCT No.: PCT/GB01/02131

§ 371 (c)(1),
(2), (4) Date: Nov. 4, 2002

(87) PCT Pub. No.: WO01/91239

PCT Pub. Date: Nov. 29, 2001

(65) Prior Publication Data

US 2003/0092325 A1 May 15, 2003

(51) Int. Cl.[7] ..... H01R 4/36

(52) U.S. Cl. ..... 439/810; 439/814; 439/877; 174/65 R; 174/135

(58) Field of Search ..... 174/65 R, 72 A, 174/135, 74 R, 75 D, 82, 78; 439/810, 814, 278, 877, 882; D13/151, 133

(56) References Cited

U.S. PATENT DOCUMENTS

| | | | | | |
|---|---|---|---|---|---|
| 2,076,209 | A | * | 4/1937 | Rowe | 439/810 |
| 2,732,535 | A | * | 1/1956 | Hammerly | 439/814 |
| 2,811,704 | A | * | 10/1957 | Newman | 439/814 |
| 3,374,456 | A | * | 3/1968 | Evans | 439/814 |
| 3,551,876 | A | * | 12/1970 | Walter | 439/810 |
| 3,609,657 | A | * | 9/1971 | Stanback | 439/814 |
| 3,638,173 | A | * | 1/1972 | Middendorf et al. | 439/814 |
| 3,650,025 | A | * | 3/1972 | McLaughlin et al. | 439/814 |
| 3,683,414 | A | | 8/1972 | DeAngelo et al. | 339/272 |
| 4,146,290 | A | * | 3/1979 | Annas et al. | 439/810 |
| 4,269,465 | A | * | 5/1981 | Mueller | 439/431 |
| 4,327,957 | A | * | 5/1982 | Cooper et al. | 439/814 |
| 4,427,258 | A | * | 1/1984 | Mueller | 439/814 |
| 4,603,376 | A | * | 7/1986 | Maier | 439/814 |
| 4,764,132 | A | * | 8/1988 | Stutz, Jr. | 439/810 |
| 4,861,290 | A | | 8/1989 | Halmstad et al. | 439/810 |
| 5,005,104 | A | * | 4/1991 | Grunert et al. | 439/810 |
| 5,201,914 | A | * | 4/1993 | Hollick | 439/810 |
| 5,440,073 | A | * | 8/1995 | Lin et al. | 174/74 R |
| 5,493,085 | A | * | 2/1996 | Kolberg et al. | 200/51 R |
| 5,533,913 | A | * | 7/1996 | Boehm et al. | 439/810 |
| 5,539,152 | A | * | 7/1996 | Gretz | 174/65 R |
| 5,553,787 | A | * | 9/1996 | Guginsky | 174/65 R |
| 5,674,079 | A | * | 10/1997 | Auclair | 439/812 |
| 5,957,733 | A | * | 9/1999 | Mello et al. | 439/810 |
| D470,461 | S | * | 2/2003 | Liang | D13/151 |

FOREIGN PATENT DOCUMENTS

| | | |
|---|---|---|
| DE | 39 42 520 | 6/1991 |
| FR | 2 613 540 | 10/1988 |
| GB | 1144617 | 3/1969 |
| GB | 2 256 096 | 11/1992 |
| GB | 2 266 628 | 11/1993 |

OTHER PUBLICATIONS

International Search Report for PCT/GB01/02131.
International Preliminary Examination Report for PCT/GB01/02131.
Great Britain Search Report for GB00012804.1.

* cited by examiner

*Primary Examiner*—Dean A. Reichard
*Assistant Examiner*—Angel R. Estrada
(74) *Attorney, Agent, or Firm*—Myers Bigel Sibley & Sajovec

(57) ABSTRACT

A cable lug for mounting on the end of a cable for making electrical connection between a conductor of the cable and other electrical equipment. The lug includes a palm for connecting the lug to the electrical equipment, a generally elongate cylindrical barrel for receiving therein one end of the cable conductor, and an insert for disposal within the barrel and for extending around and along the inner surface of the barrel to align the lug more concentrically on smaller cables, preferably with the barrel being conveniently made with uniform wall thickness.

24 Claims, 3 Drawing Sheets

CABLE LUG

RELATED APPLICATIONS

The present application is a National Phase application of PCT/GB01/02131 filed on May 15, 2001 and published in English, which claims priority from application GB 0012804.1 filed on May 25, 2000.

FIELD OF THE INVENTION

This invention relates to a cable lug for mounting on the end of a cable for making electrical connection between a conductor of the cable and other electrical equipment.

BACKGROUND OF THE INVENTION

Such cable lugs are well known for terminating electrical power cables, and comprise a palm for connecting the lug to the electrical equipment, usually by means of a bolt passing therethrough, and a barrel, integral with the palm and usually extending therefrom, for receiving the bared end of the conductor therein. The conductor may be retained in the lug barrel by crimping, or alternatively by means of securing bolts, which may be shear head bolts. The conductor may be solid or stranded, and will usually be of aluminium or copper.

The electrical equipment may be a transformer or switchgear, with the cable lug being connected to a bushing thereof, which may be by means of a cable adapter (T- or L-shape), such as sold by Tyco Electronics Raychem GmbH under the tradename RSTI for example. Insulation of the electrical connection may alternatively be effected by a heat-recoverable sleeve, also available from Tyco Electronics Raychem GmbH.

Such cable lugs are supplied for use with cables of a defined range of sizes, effectively diameters, and it is important to select the correct size lug for the cable. This leads to the need for holding a relatively large inventory, and its associated expense. Conventional cable lugs using bolt securement have an eccentric barrel, with the wall thickness on one side being greater then on the other side in order to provide sufficient length for the threads of the bolts to be gripped therein. This results in the cable being mounted eccentrically with respect to the lug, which can be disadvantageous when providing electrical insulation therearound. The thinner wall section, usually diametrically opposed, allows the weight and cost of the lug to be minimised. It is an object of the present invention to provide a cable lug that overcomes, or at least alleviates, problems of the known lugs.

SUMMARY OF THE INVENTION

Thus in accordance with one aspect of the present invention, there is provided a cable lug for mounting on the end of a cable for making electrical connection between a conductor of the cable and other electrical equipment, wherein the lug comprises a palm for connecting the lug to the electrical equipment, a generally elongate cylindrical barrel for receiving therein one end of the cable conductor, an insert for disposal within the barrel and for extending around and along the inner surface of the barrel, whereby in operation the insert is arranged to lie between the cable conductor and the inner surface of the lug, and means for retaining the insert against movement within the barrel.

The lug of the invention thus has a separate insert, and this allows a single barrel to be used with a much larger range of cable sizes, the insert being required and inserted for use with smaller cables. This can enable the barrel to be aligned more nearly concentrically on the cable end over the whole range of sizes, than would be possible with previously known lugs. The barrel wall can be, and preferably is, of substantially uniform thickness, which may be more economical to manufacture than known lugs of varying wall thickness. Further, the retention of the insert ensures good electromechanical securement of the cable conductor in the barrel of the lug. It is envisaged that the insert will extend only partially around the inner surface of the barrel of the lug, and may extend only partially or substantially the whole length of the lug barrel.

Advantageously, the insert will be shaped as part of a generally cylindrical surface, for conformity with the inner surface of the barrel of the lug. In this case, the insert will be circumferentially located within the barrel generally opposite the threaded aperture in the barrel by which the lug is secured to the cable. However, it is also envisaged that the insert may be of full cylindrical configuration, formed for example as a single pressing, in which case it is preferably apertured at diametrically-opposed locations to receive therethrough the means to secure the insert to the barrel and the means to secure the lug to the cable respectively.

It will be appreciated that retention of the insert is required during insertion of the cable conductor into the barrel in order to ensure good mechanical and electrical connection, and also advantageously prior to such insertion. The retaining means may secure the insert against rotational and/or longitudinal movement in one or both directions. The retaining means preferably comprises a projection of one of the barrel and insert, advantageously, of the insert, and a co-operating aperture of the other. Such interengagement may be provided at any suitable location along and around the insert. The aperture may be an indentation or a through-hole. It will be appreciated that two, or more, projections and respective apertures may be provided. In a preferred embodiment, the retaining means includes a hole extending completely through the side wall of the barrel.

Preferably, the cable lug is made of aluminium or copper. Consequently, it is desirable to tin the inner surface of the barrel of the lug, and the hole therein conveniently allows passivating solution to flow into, through, and out of the barrel. Advantageously, the insert and/or the barrel is grooved on its inner surface to enhance connection with the cable conductor. Such grooves may extend longitudinally or circumferentially. Advantageously, the grooves of the barrel are located only over its innermost region, beyond the position at which the lug is fixed to the cable. Preferably, at least one shear head bolt is provided for securing the lug to the cable. The cable lug of the invention may be sized to suit various cable sizes, for example diameters of 95 to 240 $mm^2$ or 25 to 95 $mm^2$.

It is understood that although the cable lug of the present invention is primarily for use with the termination of a cable, the other electrical equipment may itself comprise another cable. Accordingly, the cable lug may be employed in a cable joint, formed, for example, by the use of two such lugs fitted to respective cables.

BRIEF DESCRIPTION OF THE DRAWINGS

Embodiments of cable lug, each in accordance with the present invention, will now be described, by way of example, with reference to the accompanying drawings, in which.

DETAILED DESCRIPTION OF THE ILLUSTRATED EMBODIMENTS

Figure 1:
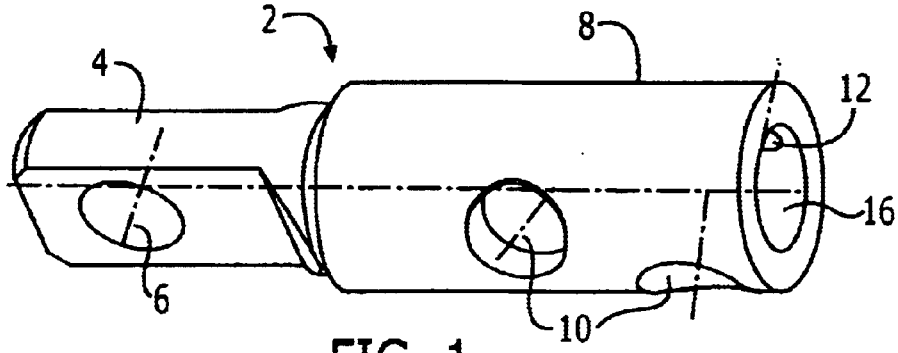
FIG. 1 is an isometric view of a first embodiment of lug.
Figure 2:
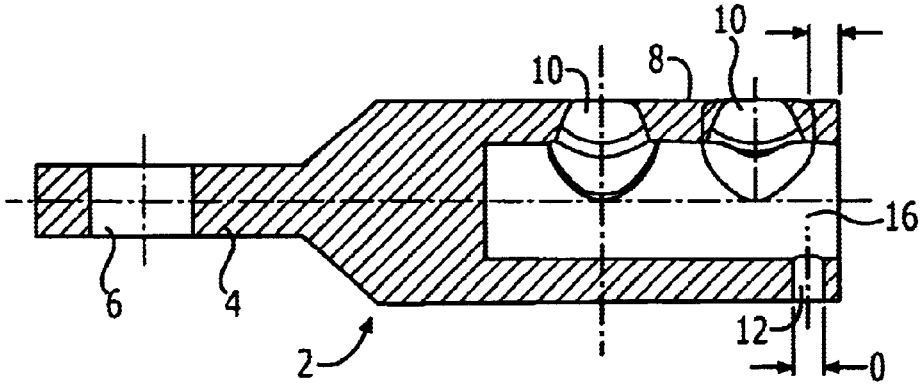
FIG. 2 is a sectional elevation of the lug of FIG. 1.

Referring to FIGS. 1 to 5, an aluminium cable lug 2 comprises a generally rectangular palm 4 having an aperture 6 therethrough, and integral therewith a generally hollow cylindrical barrel 8, which is elongate and of uniform wall thickness. To one side, the barrel 8 has two threaded holes 10 tapped through the side wall thereof, the holes 10 being axially and circumferentially offset from one another. A smaller hole 12 extends through the side wall of the cylindrical surface of the barrel 8 substantially diametrically opposed to the holes 10.

Figure 5:
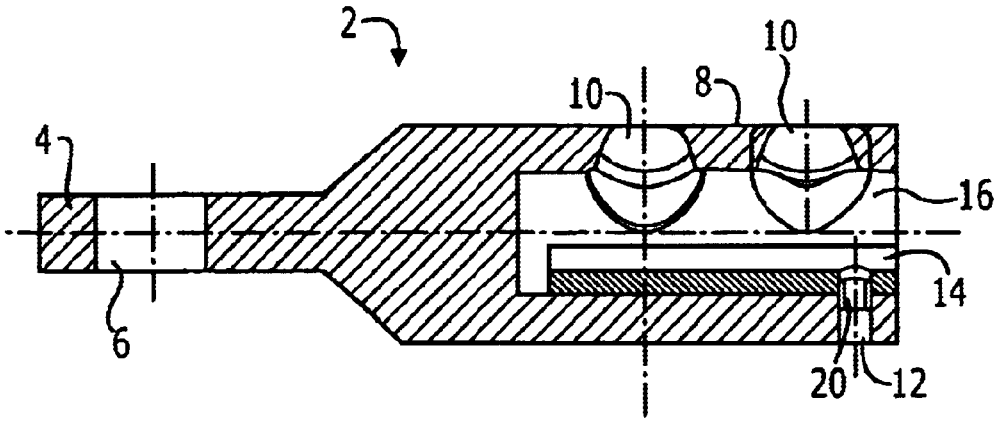
FIG. 5 is a sectional elevation corresponding to FIG. 2 with the insert of FIG. 4 located therein.

An aluminium insert 14 is shaped so as to have a part-cylindrical form, and is sized so as to fit conformingly within the bore 16 of the lug barrel 8. As can be seen from FIG. 5, the insert 14 extends somewhat less than half-way around the inner circumference of the lug barrel 8, and substantially three quarters of the length therealong from the open end. The insert 14 has a hole 18 drilled through the curved surface thereof in such a location that when the insert 14 is disposed within the cable lug bore 16, as shown in FIG. 5, the insert hole 18 can be aligned with the barrel hole 12. A stud 20 (FIG. 4) may be inserted into the hole 18, and arranged to engage the barrel hole 12 (FIG. 5) so as securely to retain the insert 14 within the barrel 8 of the lug 2 against both longitudinal and rotational movement in each direction. It is preferred that the insert 14 be provided with grooves that extend longitudinally thereof, and that the inner surface of the barrel 8 be provided with grooves that extend circumferentially thereof, in each case to enhance gripping of the inserted cable conductor.

Figure 12:
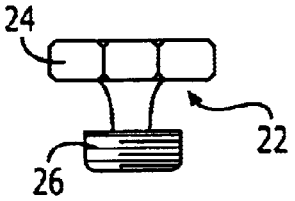
FIG. 12 is an elevation of a shear head bolt for use in the lug.

In operation, an electrical power cable (not shown) has its outer layers stripped so as to expose the conductor at an end thereof, and the bared conductor is inserted into the cable lug bore 16. Two shear head bolts 22 (FIG. 12) are screwed into respective of ones of the barrel holes 10 and tightened onto the cable conductor so as to urge it tightly against the inner surface of the insert 14. Tightening is carried out until the bolt heads 24 shear at a predetermined torque leaving the threaded bolt portions 26 enclosed within the wall thickness of the lug barrel 8.

Figure 3:
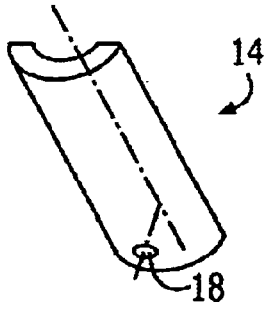
FIG. 3 is an isometric view of an insert of the lug of FIG. 1.
Figure 4:
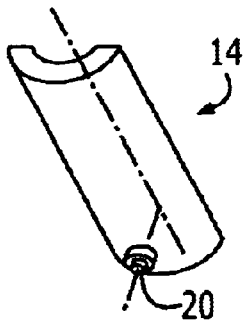
FIG. 4 is a view of the insert of FIG. 1 having a stud secured therein.

It will appreciated that the positioning of the hole 18 in the insert 14 need not be towards one end thereof as shown in FIG. 3, but could be elsewhere in the surface, to align with a correspondingly-located hole 12 in the lug barrel 8. The insert stud 20 may either be firmly secured into the insert 14 and located in the barrel hole 12 as a sliding fit. Alternatively, the insert 14 may be located within the barrel 8 with the holes 18 and 12 in alignment and the stud 20 may subsequently be inserted therethrough from outside the lug so as to secure the insert 14 to the barrel 8. It will be appreciated that should the cable that is to be inserted into the lug 2 be of a larger size, then the insert may be dispensed with.

Figure 6:
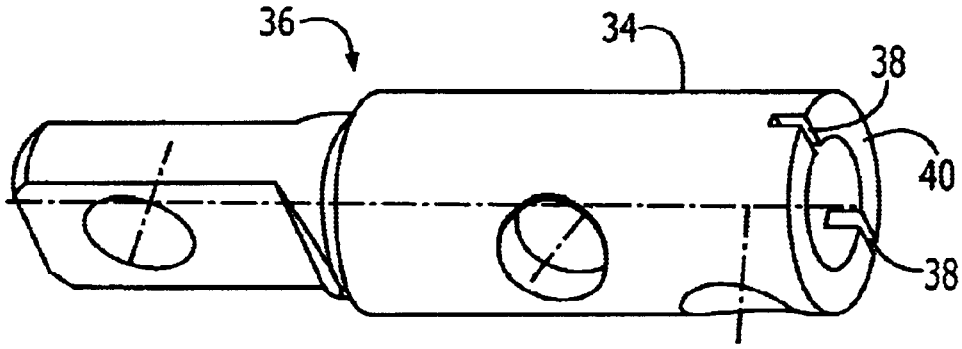
FIG. 6 is an isometric view of a second embodiment of lug.
Figure 7:
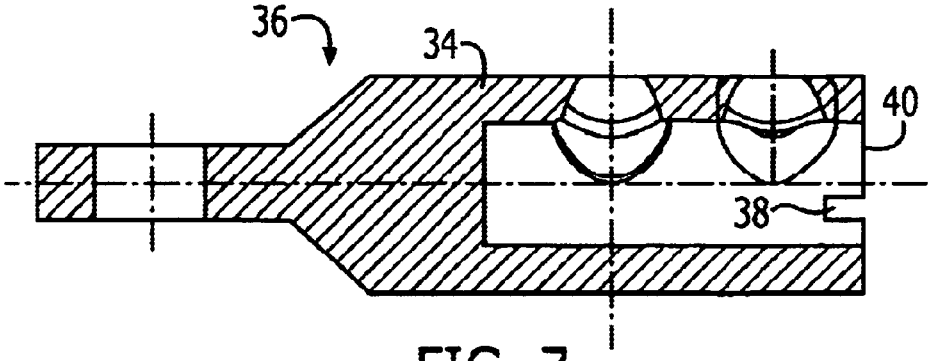
FIG. 7 is a sectional elevation of the lug of FIG. 6.
Figure 8:
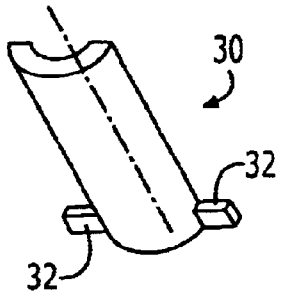
FIG. 8 is an isometric view of an insert of the lug of FIG. 6.
Figure 9:
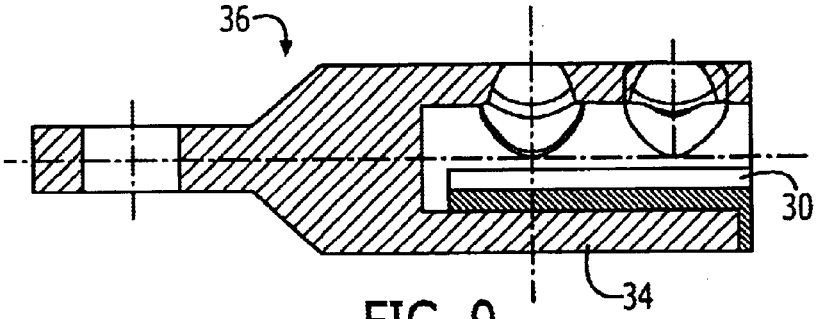
FIG. 9 is a sectional elevation showing the insert of FIG. 8 located in the lug of FIG. 7.

Referring to the second embodiment of lug 36 shown in FIGS. 6 to 8, a curved part-cylindrical lug insert 30 has a pair of projections 32 extending in substantially opposed-radial directions therefrom at one end. Interengagement of the insert 30 with the barrel 34 of the lug 36 is provided by the barrel 34 having a pair of corresponding-positioned slots 38 in the end face 40 thereof, into which the projections 32 are a tight sliding fit. The insert 30 is thus retained against rotational movement in each direction with respect to the axis of the lug, and also against being pushed further into the lug barrel when a cable is inserted therein. In a modification of the lug 36, the slots may be L-shaped so that a bayonet connection may be formed by introducing the insert 30 longitudinally into the barrel 34 and then rotating it to cause the projections 32 to engage the slot extensions.

Figure 10:
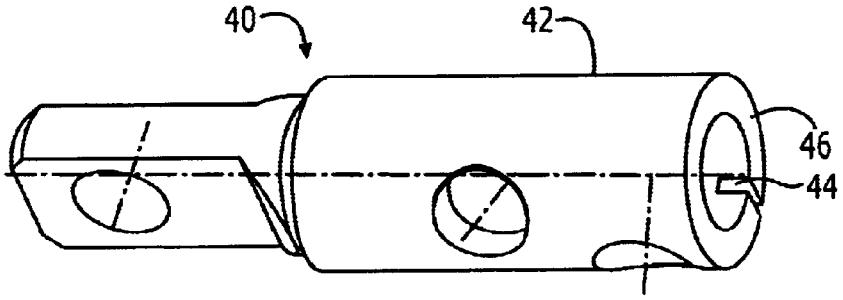
FIG. 10 is an isometric view of a third embodiment of lug.
Figure 11:
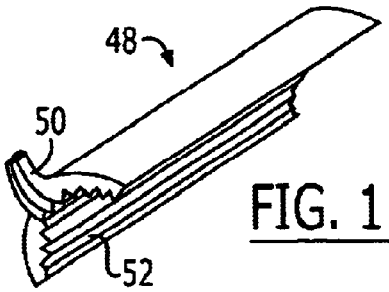
FIG. 11 is an isometric view of an insert of the lug of FIG. 10.

Referring to the third embodiment shown in FIGS. 10 and 11, a lug 40 has a substantially cylindrical barrel 42 with a single radial slot 44 in the end face 46 thereof. A part-cylindrical insert 48 has a longitudinal extension 50 thereof bent through 90 degrees so as to project in a radial direction therefrom. Insertion of the insert 48 into the barrel 42 of the lug 40 then results in the projection 50 engaging within the slot 44, thereby to secure the insert 48 against rotational and further inward longitudinal movement. FIG. 11 also shows the longitudinal grooves 52 of the insert 48, as are preferably applied to each of the inserts described herewithin.

It is to be appreciated that various features of the embodiments disclosed herein maybe interchanged or combined with each other as appropriate.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A cable lug for mounting on the end of a cable for making electrical connection between a conductor of the cable and other electrical equipment, wherein the lug comprises a palm for connecting the lug to the electrical equipment, a generally elongate cylindrical barrel for receiving therein one end of the cable conductor, an insert for disposal within the barrel and for extending around and along an inner surface of the barrel, the insert being arranged to lie between the cable conductor and the inner surface of the barrel, and means for retaining the insert against movement within the barrel, the cable lug further comprising at least one bolt extending through a side wall of the barrel for securing the cable conductor therein and wherein the insert is arranged to be retained within the barrel at a circumferential position substantially opposite to the at least one securing bolt.

2. A cable lug according to claim 1, wherein the retaining means is arranged to retain the insert against rotational movement, in both rotational directions, with respect to the inner surface of the barrel.

3. A cable lug according to claim 2, wherein the retaining means is arranged to retain the insert against longitudinal movement, in both longitudinal directions, with respect to the inner surface of the barrel.

4. The cable lug of claim 1 wherein the palm is mechanically coupled to the barrel on a first end thereof and the insert is disposed within the barrel through an opening at an opposite end of the barrel.

5. The cable lug of claim 1 wherein the barrel is conductive.

6. A cable lug according to claim 1, for mounting on the end of a cable for making electrical connection between a conductor of the cable and other electrical equipment, wherein the lug comprises a palm for connecting the lug to the electrical equipment, a generally elongate cylindrical barrel for receiving therein one end of the cable conductor, an insert for disposal within the barrel and for extending around and along an inner surface of the barrel, the insert being arranged to lie between the cable conductor and the inner surface of the barrel, and means for retaining the insert against movement within the barrel and wherein the retaining means comprises a projection on one of the barrel and the insert and a co-operating aperture in the other of the barrel and the insert.

7. A cable lug according to claim 6, wherein the projection extends from the insert at one end of the insert and is arranged to engage an aperture in the barrel, which aperture comprises a slot in an end face of the barrel.

8. A cable lug according to claim 6, wherein the projection comprises a stud extending from an outer surface of the insert, and wherein the aperture extends through the inner surface of the barrel.

9. A cable lug according to claim 6, wherein the insert has grooves extending longitudinally of an inner surface thereof.

10. A cable lug according to claim 6, made substantially of tinned aluminium.

11. A cable lug according to claim 6, further comprising at least one bolt extending through a side wall of the barrel for securing the cable conductor therein.

12. A cable lug according to claim 11, wherein the at least one securing bolt comprises a shear head bolt.

13. A cable lug according to claim 11, wherein the insert is arranged to be retained within the barrel at a circumferential position substantially opposite to the at least one securing bolt.

14. The cable lug of claim 6 wherein the barrel is conductive.

15. A cable lug for electrically connecting a conductor, the cable lug comprising:

an elongate barrel having a substantially cylindrical bore extending longitudinally from an end of the barrel, the bore being configured to receive the conductor;

a curved insert positioned within the bore and extending longitudinally along a first side of the bore and configured to receive the conductor between the insert and an opposite side of the bore; and a projection on at least one of the curved insert and the barrel and an aperture in the other of the curved insert and the barrel, the aperture being positioned to receive the projection to limit movement of the insert in the bore.

16. The cable lug of claim 15 wherein the insert is curved to substantially conform with the first side of the bore at least part way around a circumference of the bore.

17. The cable lug of claim 15 further comprising a palm at an end of the lug opposite the barrel, wherein the palm is configured to connect the lug to electrical equipment.

18. The cable lug of claim 17 further comprising at least one bolt movably mounted in a sidewall of the barrel opposite the curved insert that is configured to retain the conductor in the bore between the at least one bolt and the insert.

19. The cable lug of claim 15 wherein the projection and aperture are configured to limit longitudinal and rotational movement of the insert in the bore.

20. The cable lug of claim 19 wherein the aperture comprises a slot in an end face of the barrel.

21. The cable lug of claim 20 wherein the slot comprises an L-shaped slot that provides a bayonet connection when the projection is inserted in the slot and rotated.

22. The cable lug of claim 20 further comprising a palm at an end of the lug opposite the barrel, wherein the palm is configured to connect the lug to electrical equipment.

23. The cable lug of claim 22 further comprising at least one bolt movably mounted in a sidewall of the barrel opposite the curved insert that is configured to retain the conductor in the bore between the at least one bolt and the insert.

24. A cable lug for mounting on the end of a cable for making electrical connection between a conductor of the cable and other electrical equipment, wherein the lug comprises a palm for connecting the lug to the electrical equipment, a generally elongate cylindrical barrel for receiving therein one end of the cable conductor, an insert for disposal within the barrel and for extending around and along an inner surface of the barrel, the insert being arranged to lie between the cable conductor and the inner surface of the barrel, and means for retaining the insert against movement within the barrel and wherein the retaining means comprises a projection extending from the insert at an end of the insert adjacent the opening and an aperture in an end face of the barrel at the opposite end thereof.

* * * * *

UNITED STATES PATENT AND TRADEMARK OFFICE

CERTIFICATE OF CORRECTION

PATENT NO. : 6,726,510 B2
DATED : April 27, 2004
INVENTOR(S) : Schad et al.

It is certified that error appears in the above-identified patent and that said Letters Patent is hereby corrected as shown below:

Title page,
Item [12], should read -- Schad et al. --
Item [75], Inventors, should read -- Norbert Emil Schad, Hohenlinden (DE); Falk Hardt, Muenchberg (DE) --

Column 5,
Line 22, should read -- 6. A cable lug for mounting on the --

Signed and Sealed this

Seventh Day of September, 2004

JON W. DUDAS
*Director of the United States Patent and Trademark Office*